United States Patent [19]

Nitschko

[11] 4,434,997

[45] Mar. 6, 1984

[54] SKI BINDING JAW

[75] Inventor: Theodor Nitschko, Vienna, Austria

[73] Assignee: TMC Corporation, Baar, Switzerland

[21] Appl. No.: 282,766

[22] Filed: Jul. 13, 1981

[30] Foreign Application Priority Data

Jul. 24, 1980 [AT] Austria ..... 3822/80

[51] Int. Cl.[3] ..... A63C 9/08

[52] U.S. Cl. ..... 280/625; 280/628; 280/634

[58] Field of Search ..... 280/625, 626, 628, 629, 280/630, 631, 632, 633, 634

[56] References Cited

U.S. PATENT DOCUMENTS

| | | | |
|---|---|---|---|
| 3,902,730 | 9/1975 | Tschida et al. | 280/625 |
| 3,909,030 | 9/1975 | Beyl | 280/630 |
| 4,268,064 | 5/1981 | Svoboda | 280/625 |

FOREIGN PATENT DOCUMENTS

| | | | |
|---|---|---|---|
| 30175 | 6/1981 | European Pat. Off. | 280/625 |
| 2637871 | 3/1978 | Fed. Rep. of Germany | 280/628 |

*Primary Examiner*—David M. Mitchell

*Attorney, Agent, or Firm*—Flynn, Thiel, Boutell & Tanis

[57] ABSTRACT

A front jaw for a safety ski binding includes a support member mounted on a ski having a hold-down cooperable with a ski shoe sole supported for vertical movement, a pair of centering levers cooperable with the sides of the ski shoe sole supported for pivotal movement about vertical axes, and a compensating lever supported for pivotal movement about a substantially horizontal axis. One end of the compensating lever engages the top of the sole hold-down and the other end engages the centering levers. A spring urges the centering levers inwardly, and the centering levers in turn urge the compensating lever pivotally so that it urges the hold-down downwardly. When the sole hold-down is moved upwardly during a fall, it causes pivotal movement of the compensating lever which in turn causes pivotal movement of the centering levers outwardly away from the ski shoe sole against the force of the spring. Upward movement of the sole hold-down is limited by a stop.

8 Claims, 6 Drawing Figures

SKI BINDING JAW

FIELD OF THE INVENTION

This invention relates to a jaw, in particular a front jaw, for a safety ski binding, which includes a sole hold-down arranged on a bolt and two centering levers which are supported for rotation about respective axes on a support member and can be swung out approximately laterally against the force of a spring and, more particularly, relates to such a jaw in which the sole hold-down can be moved upwardly by a force which acts upwardly on it against the force of the spring through a compensating lever, which compensating lever is arranged on the bolt, has an arm with two sections, and is pivotally supported at the intersection of the arm sections thereof on a bearing axle which is arranged on the support member.

BACKGROUND OF THE INVENTION

A jaw of the above-mentioned type is described, for example, in Austrian Patent No. 321 170, which corresponds to U.S. Pat. No. 3,902,730. In this conventional embodiment, the compensating lever is constructed as an arm on the sole hold-down and is pivotally supported with the sole hold-down for movement about an axle which extends parallel to the upper side of the ski and is provided in the binding housing. The arm of the sole hold-down engages a bent section of a slide member which is also engaged by arms of the centering levers. Both the centering levers and also the sole hold-down can be pivoted against the force of a spring which has one end supported on the slide member and its other end supported on the housing, the centering levers moving approximately laterally and the sole hold-down moving upwardly. However, this conventional jaw has some disadvantages. Since the jaw during a backward fall or a twisting backward fall of the skier releases and since this release takes place against the force of the single spring, which spring is dimensioned or adjusted only for a lateral release, the constant release force which is needed and desired for each possible release direction does not exist. The great force which acts onto the sole hold-down through the weight of the skier effects a premature release.

A jaw which at least partially compensates for the increased friction which occurs between the sole hold-down and the ski shoe sole during a backward fall is known from German OS No. 28 12 149. The sole holder of the front jaw described in this reference is arranged on a holding jaw which is provided for both laterally and vertically embracing the front area of the sole of a ski shoe. A bar which is fixedly connected to the holding jaw is pivotally supported for movement about a bearing axle which is arranged in the support member, on which axle is also pivotally supported the holding jaw. The support member is supported for rotation about a swivel pin having a flattened portion which serves as a support for an elastic locking system. The locking system consists substantially of a spring which is supported at one end on an abutment and at the other end biases a piston which in turn has a tilting element arranged swingably on it which presses, through the force of the spring, against the swivel pin. When the holding jaw is raised, some pivots with the bar about the bearing axle. A part which is connected to the bar biases the tilting element, which partially comes free from the flattened portion of the swivel pin and compresses the spring. This results in a reduction in the locking force, and thus the increased friction between the ski shoe sole and sole hold-down is compensated for. An important disadvantage of this front jaw, however, is that it is structurally expensive and has many structural parts, which also causes additional frictional forces to exist inside of the front jaw.

A purpose of the invention is therefore to design a jaw of the above-mentioned type that does not have the mentioned disadvantages of known jaws, that is designed structurally simple, and that is adapted to compensate for the additional frictional forces on the sole hold-down which occur during a twisting backward fall and, through this, achieves a constant release force for the various possible directions of a fall and release.

SUMMARY OF THE INVENTION

This purpose is attained inventively by providing a compensating lever having two arms which each have two arm sections, one of which arm sections extends into the swivelling range of a respective centering lever, wherein the compensating lever is supported on the bolt elastically with respect to the sole hold-down and the upward movement of the sole hold-down is limited by a stop.

This jaw is designed very simple. Particularly favorable points of applications for the force produced by the sole hold-down exist through the compensating lever which engages the centering levers. The elastic support of the compensating lever on the bolt assures a sufficient stability of the sole hold-down, which remains in its position relative to the ski shoe sole and only moves, so far as the stop permits, upwardly. The friction compensation is determined by the range of movement available to the sole hold-down, as limited by the stop. Thus, an undesired upward release is avoided and, during twisting falls, the desired consistent release force exists.

A particularly advantageous embodiment of the invention is characterized by the stop for the vertical range of movement of the sole hold-down being a disk provided on the end of the bolt remote from the compensating lever, the diameter of which is larger than an opening provided in a support plate of the support member and through which the bolt extends. With this, the stop for the vertical movement of the sole hold-down is achieved in a space-saving manner and by no means adversely influences the function of the jaw. This arrangement is also particularly advantageous when the support member or a base plate which carries it is adjustably supported on a guide rail, since then the bolt has sufficient space available for its vertical movement.

If the support member is secured directly on the upper side of the ski, it is advantageous inventively if the opening is arranged on a stamping which, viewed in the side view, is designed as an area of the support plate which is bent upwardly and has approximately an inverted U-shaped.

A particularly favorable lever relationship with respect to operation of the centering levers by the compensating lever results according to a further characteristic of the invention when the bearing axle of the compensating lever is arranged in a bearing sleeve constructed at the upper end area of a wall of the support member and positioned at a right angle with respect to the upper side of the ski.

The structurally simple design of the jaw is inventively favored by the arm sections of the compensating lever which project into the swivelling range of the centering levers having hook-shaped ends which extend through recesses in the wall of the support member and preferably rest on the centering levers.

If the force which is applied by the compensating lever onto the centering levers is to be kept as small as possible, then it is advantageous if two intermediate levers are arranged between the lever arms of the compensating lever which extend into the swivelling range of the centering levers and the centering levers, which intermediate levers are pivotally supported on a bearing block secured on the ski or on a base plate.

To elastically support the compensating lever, it is possible, according to a further characteristic of the invention, to provide between the compensating lever and the sole hold-down and/or the support member and elastic element which is a rubber part, a cup spring, a swivel spring or the like.

BRIEF DESCRIPTION OF THE DRAWINGS

Further details, advantages and characteristics of the invention will be discussed in greater detail hereinafter in connection with the drawings, in which.

DETAILED DESCRIPTION

Figure 1:
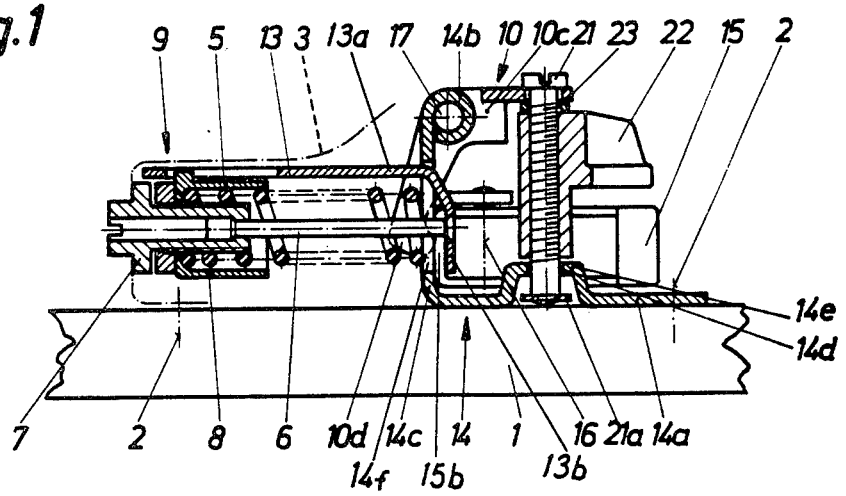
FIG. 1 is a sectional side view of a ski binding front jaw taken along the line I—I of FIG. 2.
Figure 2:
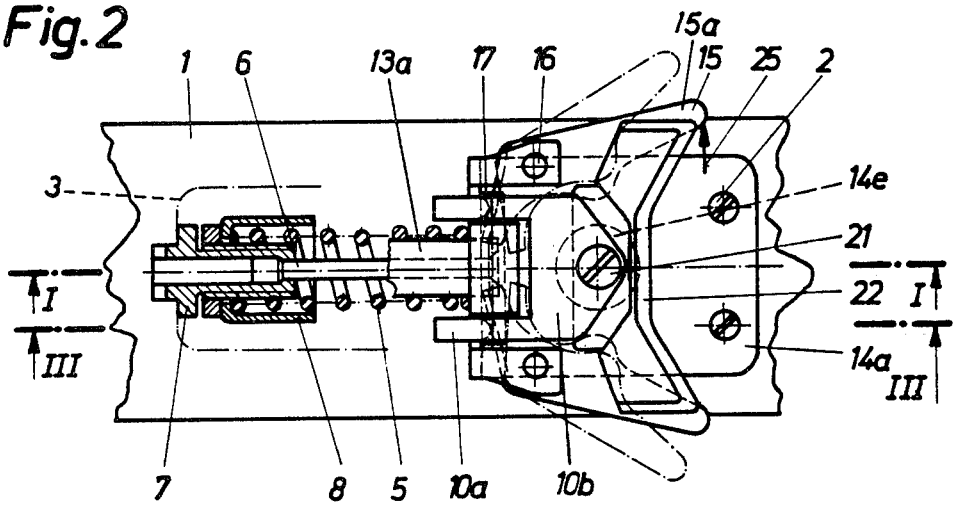
FIG. 2 is a top view of the front jaw of FIG. 1.

With reference to FIGS. 1 and 2, the general structure of a front jaw according to the invention is first discussed.

A support member 14 includes a support plate 14*a* which is secured on top of a ski 1 by means of screws 2. The support member 14 can also be arranged on a not-illustrated base plate which, in a conventional manner, is movable along a ski-fixed guide rail in the longitudinal direction of the ski and can be locked thereon in various positions. The support member 14 carries conventional angle or centering levers 15 which are pivotally supported on the support member 14 by means of vertical bolts 16. The support member 14 includes, at its end which faces the tip of the ski, a wall 14*c* which is positioned substantially at a right angle with respect to the upper side of the ski 1 and which has in its upper area a bearing sleeve 14*b*, which sleeve 14*b* supports a bearing axle 17 which in turn pivotally supports a compensating lever 10 which will yet be described in greater detail.

A helical compression spring 5 has one end disposed against the wall 14*c* of the support member 14 and the other end supported in a sleeve-shaped abutment 8. The initial tension of the spring 5 can be adjusted in a conventional manner by means of a conventional adjusting screw 7 supported in a housing 3, the spring adjustment being readable on an indicating device 9 which is conventional and therefore not described in detail.

More specifically, rotating the adjusting screw 7 causes the abutment 8 threadedly engaged therewith to move axially along the screw 7, thereby altering the distance between the abutment 8 and the wall 14*c* and thus altering the compression of the spring 5.

A draw rod 6 is arranged coaxially within the spring 5, is anchored at one end in the adjusting screw 7 and is anchored at the other end on a slide member 13 which engages the centering levers 15. The structural parts just described are substantially surrounded by a housing 3 which is indicated in dash-dotted lines in FIGS. 1 and 2.

The centering levers 15 each have two legs and are pivotally supported on the bolts 16 at the intersection of the legs, one leg 15*a* extending substantially rearwardly for engaging the ski boot and the other leg extending laterally inwardly and having an upright flange 15*b* thereon. The slide member 13 has a horizontal portion 13*a* which extends through a recess 14*f* provided in the wall 14*c* and has a downwardly extending portion 13*b* which engages the rearward sides of the flanges 15*b* of the centering levers and has the draw rod 6 anchored therein. The spring 5 urges the abutment 8, screw 7 and draw rod 6 leftwardly in FIG. 1, and the draw rod 6 urges the slide member 13 leftwardly, which in turn urges the flanges 15*b* leftwardly toward engagement with the wall 14*c*, so that the legs 15*a* of the centering levers 15 tend to pivot laterally inwardly about the axes of the bolts 16. The recess 14*f* is sufficiently narrow that the spring 5 can engage the wall 14*c* on opposite sides thereof.

A conventional hold-down 22 for a not-illustrated ski shoe sole is pivotally supported on a vertical bolt 21 through threaded engagement therewith, wherein the compensating lever 10, by means of an opening in a weblike fastening part 10*b*, pivotally supports the bolt 21. An elastic element 23 is arranged between the sole hold-down 22 and the fastening part 10*b*. The bolt 21 is provided with a screwhead, through which the bolt 21 can be roatated so that the sole hold-down 22 can be adjusted for different height ski shoe soles. The bolt 21 extends at its end remote from the screwhead through an opening 14*d* provided in an area of the support plate 14*a* which has an upwardly bent stamping 14*e* of inverted U-shape. The bolt 21 carries a disk 21*a* at its lower end, the diameter of which is larger than the diameter of the opening 14*d*.

The disk 21*a* is spaced below the opening 14*d* in the area 14*e* of the support member 14, and the bolt 21 is movable upwardly relative to the support member 14 until the disk 21*a* engages the underside of the area 14*e* of the support member 14.

Figure 3:
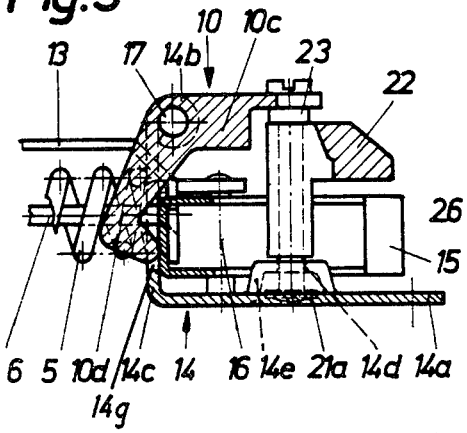
FIG. 3 is a sectional view taken along the line III—III of FIG. 2 which illustrates part of the front jaw of FIG. 1.
Figure 6:
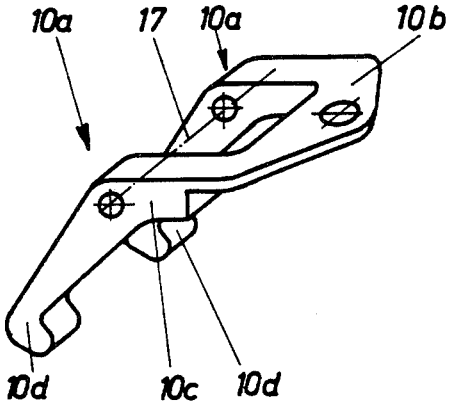
FIG. 6 is a perspective view of a compensating lever which is a component of the front jaw embodiments illustrated in FIGS. 1 and 5.

The details of the compensating lever 10 can best be taken from FIG. 6. Starting out from the fastening part 10*b*, the compensating lever 10, viewed in the top view, is approximately U-shaped and has on each side an arm 10*a* which, approximately at its center, is bent at an obtuse angle and thus has two arm sections 10*c* and 10*d*. The free ends of the arm sections 10*d* are each hook-shaped, extend through a recess 14*g* (FIG. 3) in the wall 14*c* of the support member 14 and rest on the front side of a respective one of the flanges 15*b* of the centering levers 15. The compensating lever 10 is pivotally supported, by means of openings provided in its arms 10*a* at the intersection of the arm sections 10*c* and 10*d*, on the bearing axle 17 which itself is supported in the bearing sleeve 14*b* of the support member 14.

As described above, the spring 5, acting through the draw rod 6 and slide member 13, urges the flanges 15*b* of the centering levers 15 leftwardly in FIG. 1. The flanges 15*b* in turn urge the free ends of the compensating lever arm sections 10*d* leftwardly, causing the compensating lever 10 to be pivotally urged clockwise about the axle 17 and the fastening part 10*b* thereof to act through the elastic element 23 and urge the sole hold-down and bolt 21 downwardly.

The sequence of movement in a purely horizontal release can be seen from FIG. 2. If a leg 15*a* of one of the centering levers 15 is urged horizontally outwardly by a ski shoe in the direction indicated by the arrow 25 in FIG. 2, then the lever 15 pivots about its associated bolt 16 into the position which is illustrated by dash-dotted lines in FIG. 2. During this swivelling movement, the slide member 13 which engages the centering lever 15 is moved, together with the draw rod 6, the adjusting screw 7 and the abutment 8, in the longitudinal direction of the ski toward the sole hold-down 22, causing the spring 5 to be further compressed.

Figure 4:
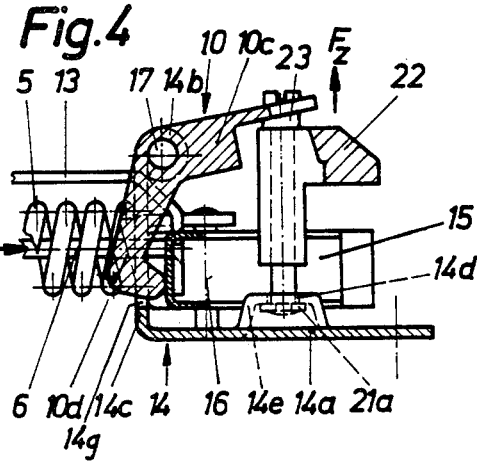
FIG. 4 is a sectional view similar to FIG. 3 illustrating the structure of FIG. 3 in a different position of operation.

If a twisting rearward fall occurs, a not-illustrated ski shoe acts with an upward force component, indicated by the arrow $F_z$, onto the sole hold-down 22, causing the sole hold-down and bolt 21 to move upwardly. The compensating lever 10 which is connected to the sole hold-down 22 is pivoted counterclockwise about the bearing axle 17 by this and the hook-shaped ends of the arm sections 10*d* of the compensating lever 10 act on the flanges 15*b* of the centering levers 15 so that the arms 15*a* of the levers 15 swing outwardly about the axes of the bolts 16. The swiveling movement of the centering levers 15 results in rightward movement of the slide member 13 similar to that which occurs during a horizontal release, so that the spring 5 is compressed. This slide member movement is indicated by the arrow 26 in FIG. 4. Upward movement of the sold hold-down 22 and swivelling movement of the compensating lever 10 are limited by the disk 21*a* of the bolt 21 hitting the stamping 14*e* of the support plate 14.

The additional frictional forces which occur between the ski shoe sole and the sole hold-down 22 during a twisting rearward fall are compensated for by the automatic opening of the centering levers 15 which normally rest laterally on the ski shoe, so that the total release force remains constant, namely, it corresponds with the force required to effect a purely horizontal release. The elastic element 23 facilitates the swivelling movement of the compensating lever 10 without tilting the sole hold-down 22 from its position relative to the upper side of the ski.

Figure 5:
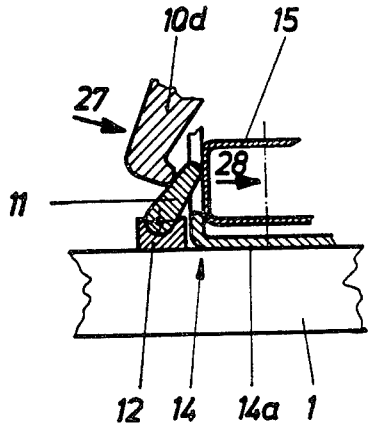
FIG. 5 is a sectional view similar to FIG. 3 illustrating part of an alternative embodiment of the front jaw of FIG. 1.

FIG. 5 illustrates a further embodiment, in which the centering levers 15 are engaged by intermediate levers 11 arranged between the lever arms 10*a* of the compensating lever 10 and the centering levers 15. The intermediate levers 11 are pivotally supported on the respective outer sides of a ski-fixed bearing block 12. When a force acts onto the sole hold-down 22 from below, the hook-shaped ends of the lever arms 10*a* of the compensating lever 10 act on the intermediate levers 11, which in turn cause the centering levers 15 to carry out a swivelling movement about their bolts 16. This sequence of movement is indicated by the arrows 27 and 28 in FIG. 5. The provision of the intermediate levers 11 is mainly advantageous when the force which is to be applied by the compensating lever 10 onto the centering levers 15 is to be maintained as small as possible.

The invention is not limited to the illustrated exemplary embodiment, and in particular is not limited to the described front jaw. The compensating lever can be arranged on front jaws which have any desired type of centering levers.

Also, various modifications are conceivable without leaving the scope of protection. The elastic element may, for example, be arranged between the compensating lever and the area of the support member in which the bolts of the centering levers are supported. If the jaw is arranged on a guide rail, the construction of a stamping is not needed on the support plate, since between the support member and the guide rail there will be sufficient space for the vertical movement of the disk on the bolt. Also, it is possible to provide the stop for limiting vertical movement of the sole hold-down on a different jaw part, for example on the housing. Furthermore, it would also be conceivable for the compensating lever to engage and act on the draw rod or the slide member.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding jaw which can releasably secure a ski boot on a ski and includes: a support member; two centering levers which are respectively supported on said support member for pivotal movement about generally vertical first and second axes, said first and second axes being spaced from each other and each said centering lever having a first leg and a second leg, said first legs each being arranged to engage the sole of said ski boot and said second legs projecting inwardly toward each other; resilient means cooperable with said second legs of said centering levers for yieldably urging pivotal movement of each said centering lever in a first direction in which said first leg thereon moves toward said ski boot; and a sole hold-down supported on a generally vertical bolt; the improvement comprising: means supporting said bolt for substantially vertical movement with respect to said support member; stop means for limiting upward movement of said bolt relative to said support member; and a compensating lever which is supported on said support member for pivotal movement about a generally horizontal axis and is operatively coupled to said bolt; said compensating lever being respectively pivoted in second and third directions in response to upward and downward movement of said bolt and being operatively coupled to said second leg of each said centering lever; upward movement of said sole hold-down and said bolt pivoting said compensating lever in said second direction and said compensating lever thereby pivoting said centering levers in a fourth direction opposite said first direction against the urging of said resilient means so that said first legs of said centering levers move away from said ski boot; wherein said stop means includes said support member having a support plate with an opening therethrough, said bolt extending through said opening; and wherein said stop means includes a disk which is supported on said bolt below said support plate and has a diameter which is larger than said opening which is provided in said support plate.

2. The jaw according to claim 1, wherein said opening is provided in an upwardly bent region of said support plate.

3. In a safety ski binding jaw which can releasably secure a ski boot on a ski and includes: a support member; two centering levers which are respectively supported on said support member for pivotal movement about generally vertical first and second axes, said first and second axes being spaced from each other and each said centering lever having a first leg and a second leg, said first legs each being arranged to engage the sole of said ski boot and said second legs projecting inwardly toward each other; resilient means copperable with said second legs of said centering levers of yieldably urging pivotal movement of each said centering lever in a first direction in which said first leg thereon moves toward said ski boot; and a sole hold-down supported on a generally vertical bolt; the improvement comprising: means supporting said bolt for substantially vertical movement with respect to said support member; stop means for limiting upward movement of said bolt relative to said support member; and a compensating lever which is supported on said support member for pivotal movement about a generally horizontal axis and is operatively coupled to said bolt; said compensating lever being respectively pivoted in second and third directions in response to upward and downward movement of said bolt and being operatively coupled to said second leg of each said centering lever; upward movement of said sole hold-down and said bolt pivoting said compensating lever in said second direction and said compensating lever thereby pivoting said centering levers in a fourth direction opposite said first direction against the urging of said resilient means so that said first legs of said centering levers move away from said ski boot; wherein said support member includes a wall which extends transversely of and is positioned substantially at a right angle with respect to the upper side of said ski and is located on a side of said centering levers remote from said ski boot, said wall having a bearing sleeve adjacent the upper end thereof; including an axle which extends through said bearing sleeve, said axle pivotally supporting said compensating lever; wherein two recesses are provided in said wall of said support member; and wherein said compensating lever includes two spaced arm sections which each extend through a respective said recess in said wall of said support member and which each have a hook-shaped bent end region which engages said second leg of a respective said centering lever.

4. The jaw according to claim 3, including two intermediate levers pivotally supported on said support member, each said intermediate lever being disposed between said second leg of a respective said centering lever and said end region of a respective said arm section of said compensating lever.

5. The jaw according to claim 3, wherein said compensating lever is generally U-shaped and has a bight and two spaced, generally parallel arms, said arms having transverse, aligned openings therethrough at locations spaced from said bight, said horizontal axle extending through said aligned openings in said arms of said compensating lever to effect said pivotal support of said compensating lever; and wherein each said arm section of said compensating lever is a portion of a respective said arm thereof and is located at the end of such arm remote from said bight.

6. In a safety ski binding jaw which can releasably secure a ski boot on a ski and includes: a support member; two centering levers which are respectively supported on said support member for pivotal movement about generally vertical first and second axes, said first and second axes being spaced from each other and each said centering lever having a first leg and a second leg, said first legs each being arranged to engage the sole of said ski boot and said second legs projecting inwardly toward each other; resilient means cooperable with said second legs of said centering levers for yieldably urging pivotal movement of each said centering lever in a first direction in which said first leg thereon moves toward said ski boot; and a sole hold-down supported on a generally vertical bolt; the improvement comprising: means supporting said bolt for substantially vertical movement with respect to said support member; stop means for limiting upward movement of said blot relative to said support member; and a compensating lever which is supported on said support member for pivotal movement about a generally horizontal axis and is operatively coupled to said bolt; said compensating lever being respectively pivoted in second and third directions in response to upward and downward movement of said bolt and being operatively coupled to said second leg of each said centering lever; upward movement of said sole hold-down and said bolt pivoting said compensating lever in said second direction and said compensating lever thereby pivoting said centering levers in a fourth direction opposite said first direction against the urging of said resilient means so that said first legs of said centering levers move away from said ski boot; wherein said compensating lever has an arm with an opening therethrough, said bolt extending through said opening; and wherein a resilient element is provided which encircles said bolt between said compensating lever arm and said sole hold-down.

7. In a safety ski binding jaw which can releasably secure a ski boot on a ski and includes: a support member; two centering levers which are respectively supported on said support member for pivotal movement about generally vertical first and second axes, said first and second axes being spaced from each other and each said centering lever having a first leg and a second leg, said first legs each being arranged to engage the sole of said ski boot and said second legs projecting inwardly toward each other; resilient means copperable with said second legs of said centering levers for yieldably urging pivotal movement of each said centering lever in a first direction in which said first leg thereon moves toward said ski boot; and a sole hold-down supported on a generally vertical bolt; the improvement comprising: means supporting said bolt for substantially vertical movement with respect to said support member; stop means for limiting upward movement of said bolt relactive to said support member; and a compensating lever which is supported on said support member for pivotal movement about a generally horizontal axis and is operatively coupled to said bolt; said compensating lever being respectively pivoted in second and third directions in response to upward and downward movement of said bolt and being operatively coupled to said second leg of each said centering lever; upward movement of said sole hold-down and said bolt pivoting said compensating lever in said second direction and said compensating lever thereby pivoting said centering levers in a fourth direction opposite said first direction against the urging of said resilient means so that said first legs of said centering levers move away from said ski boot; wherein said compensating lever is generally U-shaped and has a bight and two spaced, generally parallel arms, said arms having transverse, aligned openings therethrough at locations spaced from said bight; wherein said support member includes a horizontal axle which extends through said aligned openings in said arms of said compensating lever and is coincident with said generally horizontal axis, so compensating lever being pivotally supported on said horizontal axle; wherein a head is provided at the upper end of said bolt and a vertical opening is provided through said bight of said compensating lever, said vertical opening having a diameter which is somewhat greater than the diameter of the shank of said bolt and is less than the diameter of said head of said bolt; wherein said bolt extends through said opening in said bight, said head of said bolt being adjacent said bight snd said sold hold-down being spaced somewhat below said bight; and wherein a resilient element is provided which encircles said bolt between said bight of said compensating lever and said sole hold-down.

8. The jaw according to claim 7, wherein the end region of each said arm of said compensating lever engages a said second leg of a respective said centering lever on a side thereof which faces away from said ski boot.

* * * * *

UNITED STATES PATENT AND TRADEMARK OFFICE

CERTIFICATE OF CORRECTION

PATENT NO. : 4 434 997

DATED : March 6, 1984

INVENTOR(S) : Theodor Nitschko

It is certified that error appears in the above-identified patent and that said Letters Patent is hereby corrected as shown below:

Col. 7, line 13; change "copperable" to ---cooperable---.
line 14; change "of" (second occurrence) to ---for---.

Col. 8, line 18; change "blot" to ---bolt---.
line 47; change "copperable" to ---cooperable---.
line 55; change "relac-" to ---rela----.

Col. 9, line 9; change "so" to ---said---.

Col. 10, line 4; change "snd" to ---and---.
change "sold" to ---sole---.

Signed and Sealed this

Fourth Day of June 1985

[SEAL]

*Attest:*

DONALD J. QUIGG

*Attesting Officer* *Acting Commissioner of Patents and Trademarks*